US006999108B2

(12) United States Patent
Goff et al.

(10) Patent No.: US 6,999,108 B2
(45) Date of Patent: Feb. 14, 2006

(54) METHOD AND APPARATUS FOR IMAGE REGISTRATION IMPROVEMENTS IN A PRINTER HAVING PLURAL PRINTING STATIONS

(75) Inventors: Cobb S. Goff, Webster, NY (US); James E. Elly, North Chili, NY (US); Richard L. Gugino, Rochester, NY (US); Jeffrey R. Berry, Wakefield, RI (US)

(73) Assignee: Eastman Kodak Company, Rochester, NY (US)

( * ) Notice: Subject to any disclaimer, the term of this patent is extended or adjusted under 35 U.S.C. 154(b) by 32 days.

(21) Appl. No.: 10/780,304

(22) Filed: Feb. 17, 2004

(65) Prior Publication Data

US 2005/0179764 A1 Aug. 18, 2005

(51) Int. Cl.
*B41J 11/42* (2006.01)

(52) U.S. Cl. ..... 347/218

(58) Field of Classification Search ..... 347/173, 347/193, 218, 116, 117, 16; 399/298–301; 400/120.13

See application file for complete search history.

(56) References Cited

U.S. PATENT DOCUMENTS

| | | | | |
|---|---|---|---|---|
| 5,196,864 | A | 3/1993 | Caine | |
| 5,440,328 | A | 8/1995 | Nardone et al. | |
| 5,526,033 | A * | 6/1996 | Higashi et al. | 347/218 |
| 5,907,741 | A | 5/1999 | Matsuzawa et al. | |
| 6,493,012 | B1 | 12/2002 | Buch et al. | |

FOREIGN PATENT DOCUMENTS

| | | |
|---|---|---|
| JP | 59-011268 | 1/1984 |
| JP | 60-258575 | 12/1985 |
| JP | 04-236565 | 8/1992 |
| JP | 05-031930 | 2/1993 |
| JP | 11-157113 | 6/1999 |

* cited by examiner

*Primary Examiner*—Huan Tran
(74) *Attorney, Agent, or Firm*—Mark G. Bocchetti

(57) ABSTRACT

A thermal printer apparatus has a plurality of print stations for recording image information onto a receiver moving past the print stations. An adjustable-speed receiver drive mechanism is adapted to advance the receiver along the path. A plurality of sensors adapted to detect the temperature of the receiver and other surfaces along the path. A controller adjusts the speed of the drive mechanism as a function of the detected temperatures so as to effect a shim of the average raster line pitch of the printer to compensate for changes in the temperature of the receiver. An empirical model of receiver speed as a function of measured receiver temperature is used in software to predict receiver speed during printing.

21 Claims, 10 Drawing Sheets

METHOD AND APPARATUS FOR IMAGE REGISTRATION IMPROVEMENTS IN A PRINTER HAVING PLURAL PRINTING STATIONS

BACKGROUND OF THE INVENTION

1. Field of the Invention

The present invention relates to apparatus and methods for controlling temperature of print heads in a printer apparatus. More particularly, the present invention is directed to a print engine that comprises plural printing stations.

2. Description Relative to the Prior Art

In the prior art as represented by U.S. Pat. No. 5,440,328, thermal printer apparatus are known that operate as a single pass, multi-color thermal printer. In such a printer a print engine is provided that comprises a receiver transport system and three or more thermal print head assemblies. Each of the print head assemblies includes a respective reloadable thermal ribbon cassette which is loaded with a respective color transfer ribbon. Each of the thermal print head assemblies comprises a cantilevered beam, a mounting assembly and a thermal print head having a thermal print line. Each of the print head assemblies has a counterpart platen roller with which a respective print head forms a respective nip and through which the receiver passes in combination with a respective color ribbon of dye. In lieu of separate platen rollers there may be a single large roller which forms a nip with each of the print heads. The mounting assemblies allow the print heads' positions to be adjusted so that the mounting assemblies can be pivoted towards and away from the respective platen rollers. In this regard, the mounting assemblies are pivotable between an "up" position wherein the print heads are disengaged from the platen rollers and a "down" position wherein the print heads are in biased engagement with the platen rollers.

A problem with printer apparatus of the type described above is the difficulty of properly aligning the color separations on the receiver to give crisp, high quality images. Even when the print heads are accurately positioned and relative to the print drum or to the receiver pathway, there still exists the possibility for poor registration which deteriorates print quality. There is a possibility for misregistration in the direction of travel of the receiver because the receiver may stretch or become misaligned on the drum. U.S. Pat. No. 5,196,864, which issued to H. R. Caine on Mar. 23, 1993, addresses many causes of such poor registration.

Even when these causes of poor registration are negated, there exists a risk of improper color separation alignment due to changes in the velocity of the image receiver as a function of changes in the temperature of the receiver. It has been determined that the penetration depth of the drive features of a capstan roller of the receiver conveyance system is one cause of this change in receiver velocity.

As a printer is operated in such a manor as to produce many multiple prints without stop periods between prints, the internal components of the printer will retain thermal energy. Specifically, the temperature of print heads, their associated platen rollers, and other surfaces in the conveyance path that contact the receiver will increase. The internal air temperature will also increase. The overall change in temperature alters the transport characteristics of the image receiver. This change results in reducing the transport velocity of the receiver.

SUMMARY OF THE INVENTION

It is an object of the present invention to provide compensation for image receiver conveyance characteristic changes due to changes in temperature of the receiver.

According to a feature of the present invention, a thermal printer apparatus has a plurality of print stations for recording image information onto a receiver moving past the print stations. An adjustable-speed receiver drive mechanism is adapted to advance the receiver along the path. A sensor is adapted to detect the temperature of the receiver along the path. A controller adjusts the speed of the drive mechanism as a function of the detected temperature of the receiver so as to effect a shim of the average raster line pitch of the printer to compensate for changes in the temperature of the receiver.

Unexpectantly, it has been found that measuring the receiver temperature of a completed image is a good predictor of the temperature of the next succeeding image. This is true because receiver temperature changes slowing during the printing process.

We have shown experimentally that other sensors in the receiver conveyance path can be used in the same manor as the sensor to measure the receiver temperature. One specific location for an additional sensor would be located in contact with the mechanism capstan drive roller, which transports the receiver during printing. The capstan drive roller is located beyond all of the print stations and accumulates thermal energy as the receiver is transported by the capstan drive roller during printing. Sensing this temperature can be utilized to approximate the paper temperature. The advantage of multiple sensors is to maximize the accuracy of the temperature measurement.

BRIEF DESCRIPTION OF THE DRAWINGS

The invention will be described hereinafter by way of example with reference to the accompanying drawings wherein.

DESCRIPTION OF THE PREFERRED EMBODIMENTS

Figure 1:
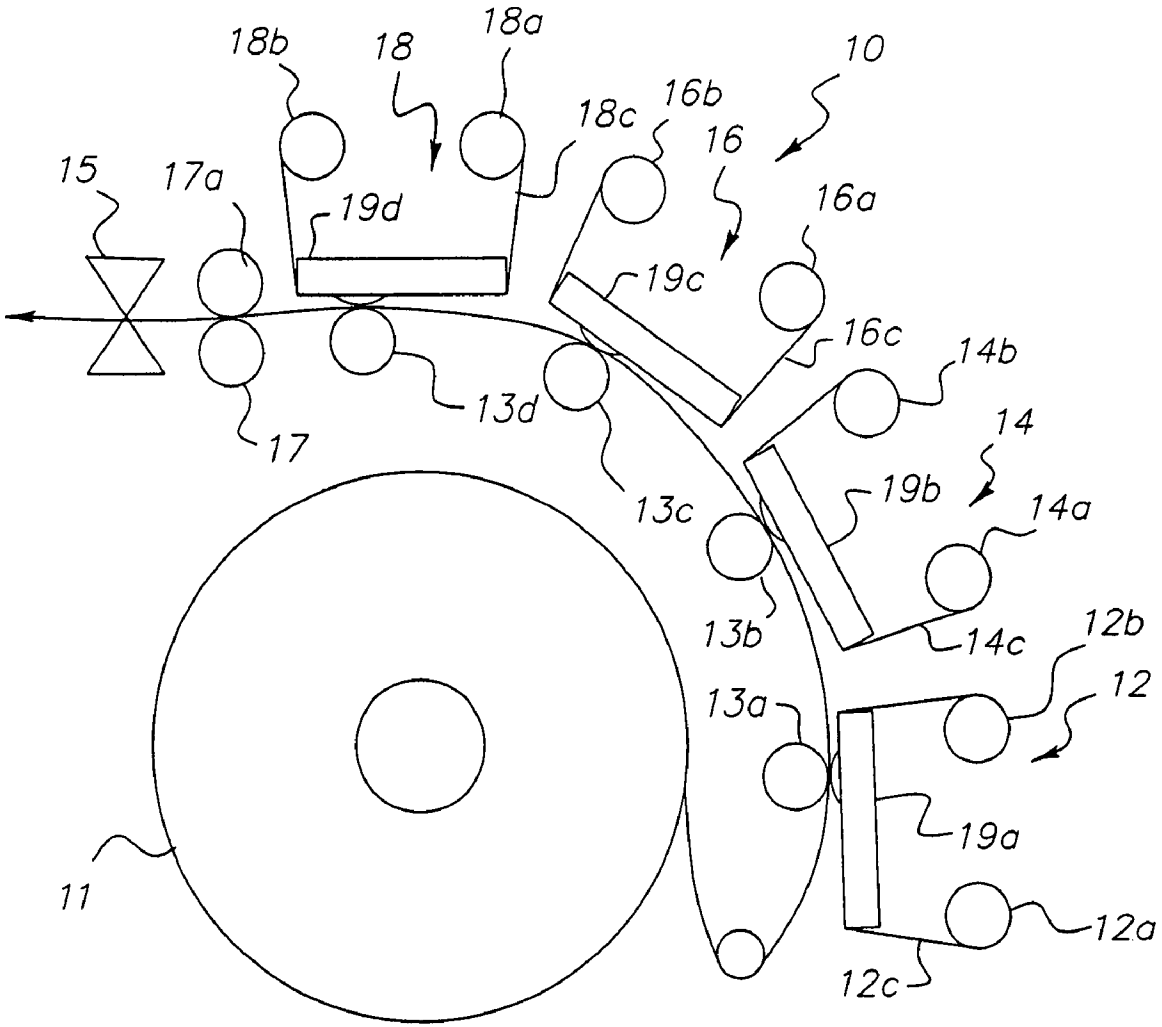
FIG. 1 is a schematic side elevation front view of a thermal print engine for use with the invention.

Referring to FIG. 1, the invention will be described with reference to a single pass, multi-color thermal printer of the type described in U.S. Pat. No. 5,440,328. In such a printer, a print engine 10 is provided that comprises a receiver transport system and three or more thermal print head assemblies 12, 14 and 16. Each of the print head assemblies includes a respective re-loadable thermal ribbon cassette assembly which is loaded with a color transfer ribbon 12*c*, 14*c* and 16*c*. Each of the thermal print head assemblies comprises a thermal print head 19*a–d* having a thermal print line. Each of the print head assemblies further has a counterpart platen roller 13*a–c* with which a respective print head forms a respective nip and through which a receiver 11 passes in combination with the respective color ribbon of dye. The mounting assemblies allow the print heads' positions to be adjusted so that the mounting assemblies can be pivoted towards and away from the respective platen rollers. In this regard, the mounting assemblies are pivotable between an "up" position wherein the print heads are disengaged from the platen rollers and a "down" position wherein the print heads are in biased engagement with the platen rollers.

Each reloadable ribbon cassette assembly comprises a cassette body including a ribbon supply roll 12*a*, 14*a* or 16*a* and a ribbon take-up roll 12*b*, 14*b* or 16*b*. The ribbon cassette assemblies are loaded with one of three or more primary color ribbons 12*c*, 14*c* and 16*c*, which are used in conventional subtractive color printing. The supply and take-up rolls of each ribbon cassette assembly are coupled to individual ribbon drive sub-assemblies when the cassette assembly is loaded into the printer for printing images on the receiver. In addition to an assembly for each of the color ribbons, there may also be provided a ribbon cassette assembly 18 that is provided with a supply of transparent ribbon 18*c* that can transfer an overcoat layer to the receiver after an image has been printed thereon. The transparent ribbon cassette assembly is similar in all respects to the other assemblies (including supply and take-up rolls 18*a* and 18*b*), and a separate print head is used to transfer the overcoat layer to the now imaged receiver. Different types of transparent ribbon may be used to provide matt or glossy finish overcoats to the final print. Alternatively, the print head associated with the transparent ribbon may have the respective recording elements suitably modulated to create different finish overcoats to the final print.

Receiver 11 having a coating thereon for receiving a thermal dye is supported as a continuous roll and threaded about platen rollers 13*a–d*. The receiver is also threaded through a nip comprised of a capstan drive roller 17 and a backup roller 17*a*. As the receiver is driven by the capstan drive roller the receiver passes by each thermal print head assembly 12, 14, and 16 a respective color dye image is transferred to the receiver sheet to form the multicolor image. For example, assembly 12 may provide a yellow color separation image, assembly 14 may provide a magenta color separation image, and assembly 16 may provide a cyan color separation image to form a three color multicolor image on the receiver sheet. Fourth assembly 18 thermally transfers the transparent overcoat to protect the color image from for example fingerprints. At each of the four assemblies there is provided a thermal print head 19*a–d* that has recording elements selectively enabled in accordance with image information to selectively transfer color dye to the receiver or in the case of the transparent ribbon to transfer the overcoat layer to the now imaged receiver sheet. At each thermal print assembly, platen rollers 13*a–d* form a respective printing nip with the respective print head 19*a–d*. As the receiver is driven through each of the respective nips, the movement of the receiver advances corresponding thermal ribbon 12*c*, 14*c*, 16*c* and 18*c* through the respective nip as well. After each multicolor image is formed, a cutter 15 may be enabled to cut the receiver into a discrete sheet containing the multicolor image protected by the transparent overcoat layer.

Figure 2:
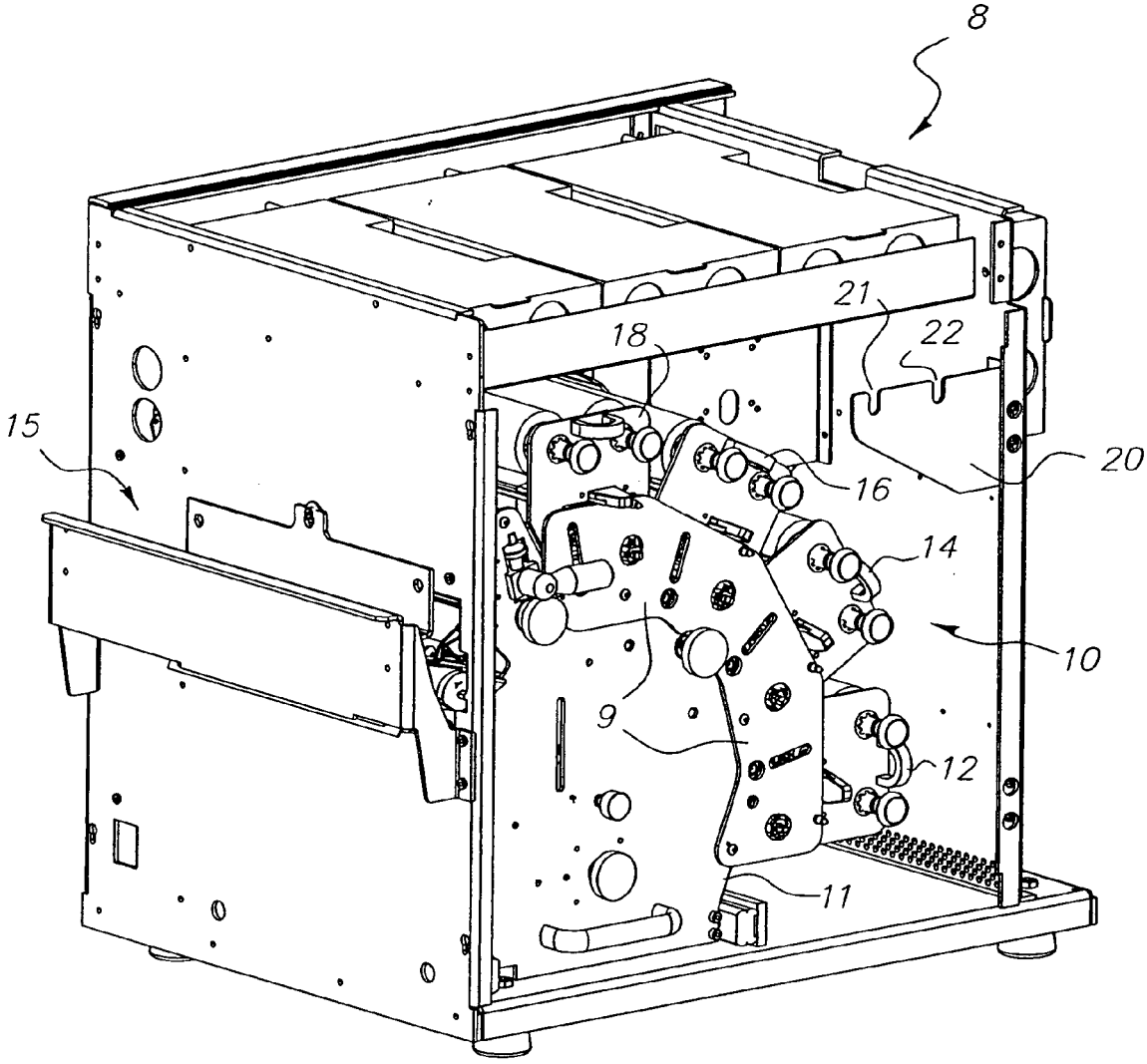
FIG. 2 is a perspective front view of a thermal printer that employs the thermal print engine of FIG. 1.

With reference now to FIG. 2, there is shown a printer apparatus 8 that includes a housing which encloses printer engine 10 illustrated in FIG. 1. FIG. 2 shows a loading aid associated with the thermal printer for facilitating loading of supply and take-up ribbon cores onto thermal ribbon cassette assemblies. A front housing door has been removed to illustrate the inside of the printer apparatus so that the various thermal print assemblies 12, 14, 16, and 18 may be seen. A loading aid bracket is supported on one of the sidewalls of the housing so as to be presented at the front opening when the front housing door (not shown) is swung open. The loading aid bracket includes a vertically upstanding plate 20 that has two vertical slots 21 and 22 formed in a top edge of the plate.

Figure 3:
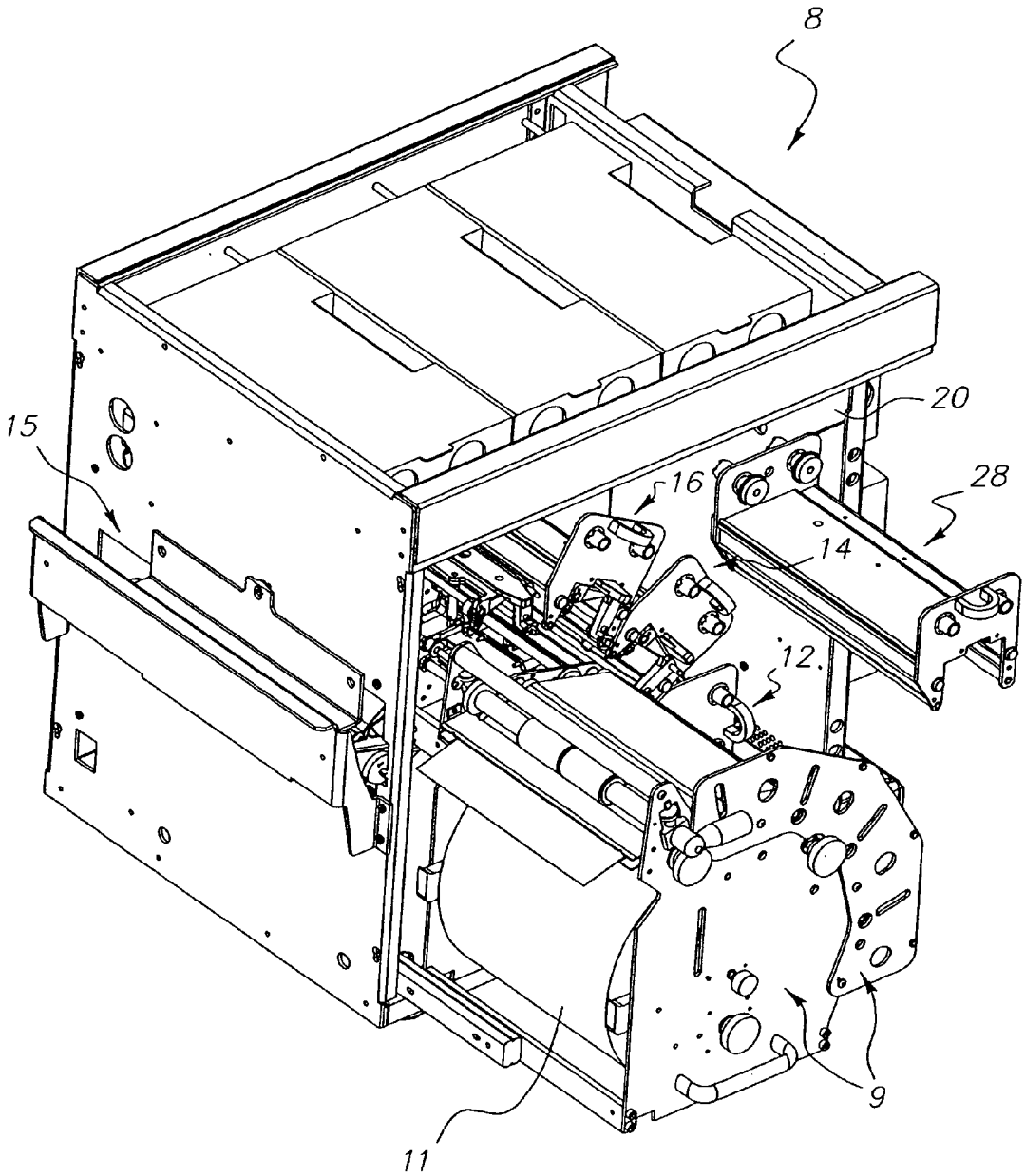
FIG. 3 is a view similar to that of FIG. 2, but illustrating a thermal ribbon cassette assembly removed from its position in a print station of the printer and mounted on a loading aid.

Referring to FIG. 3, a reloadable ribbon cassette assembly 28, which forms a part of one of the thermal print assemblies, is illustrated slid forward on a sliding rail and removed from the printer apparatus. In order for the ribbon cassette assembly to be moved forwardly, a platen assembly 9, which includes the support for roll 11 of paper receiver and all the drive components for the paper receiver including platen rollers and capstan roller, is moved forwardly to provide room for sliding movement of any of the ribbon cassette assemblies.

Figure 4:
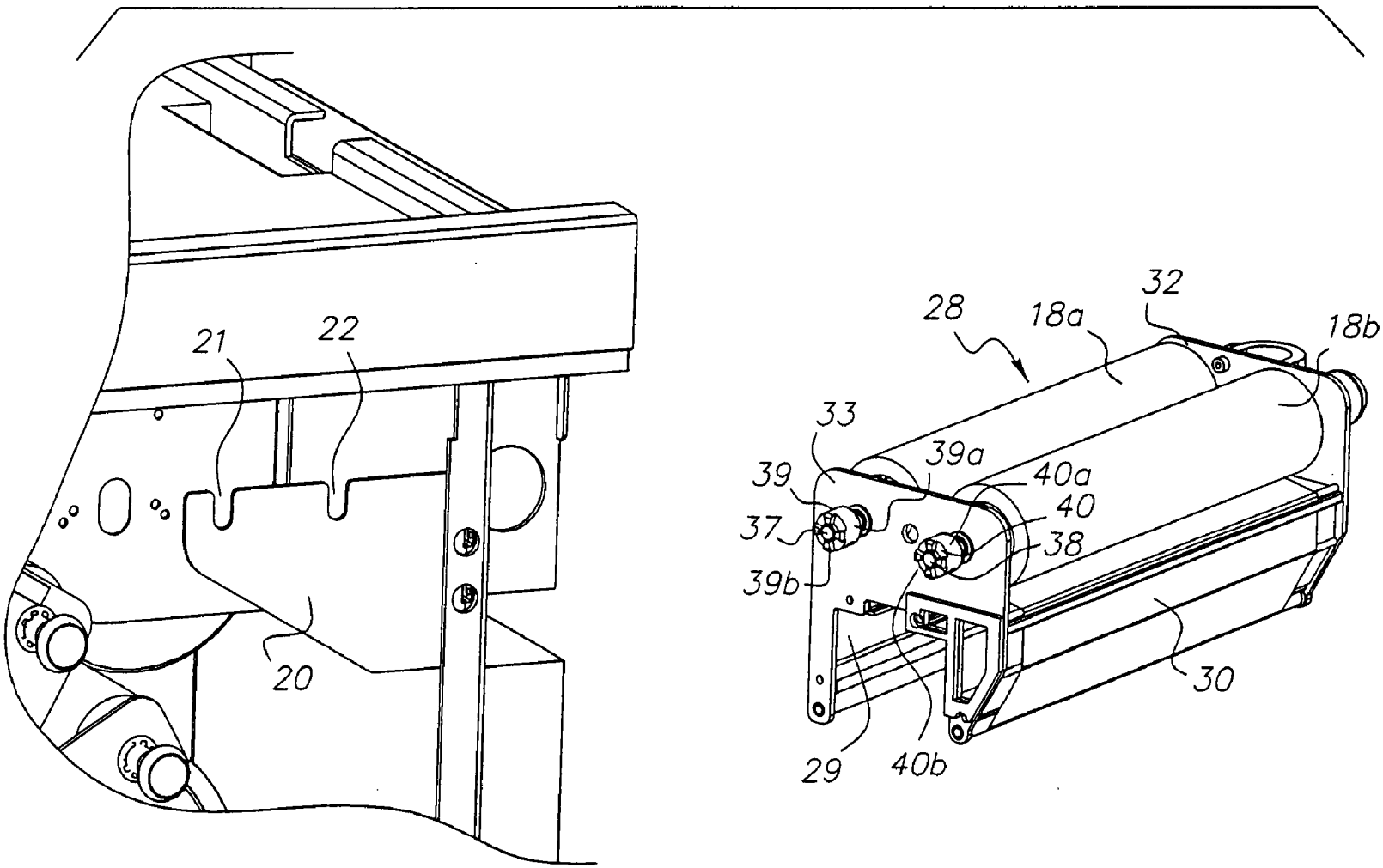
FIG. 4 is a close-up view in perspective of a loading aid and a thermal ribbon cassette assembly.
Figure 6:
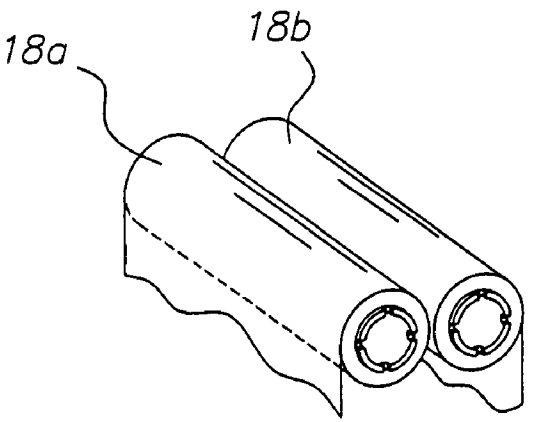
FIG. 6 is a view of the rear end of each of supply and take-up rolls showing the respective cores with notches.

FIG. 4 shows a rear view of ribbon cassette assembly 28 removed from the printer apparatus and a close-up view of loading aid bracket 20 that is fixed to the frame of the printer apparatus. The ribbon cassette assembly includes a central extrusion of, say, aluminum having depending right and left sidewalls 29 and 30 and front and back walls 32 and 33 that are attached to the aluminum extrusion. Supply and take-up rolls 18*a* and 18*b* for this particular ribbon are supported on the ribbon cassette assembly. While not shown in FIG. 4, the ribbon would extend from supply roll 18*a* around the right and left depending sidewalls 29 and 30 and up to take-up roll 18*b*. The ribbon cassette assembly includes appropriate supports 35*f*, 35*r*, 36*f* and 36*r* (see also FIG. 7) for supporting each of the supply and take-up rolls on respective supports at the front and back ends thereof. In this regard, each of the supply and take-up rolls may include a core upon which the ribbon material is adapted to be wound. The supports for the respective cores may comprise insert devices each of which engage a respective end of each core and support the core for rotation at that end. The insert devices in the rear may have pins or projections as shown to engage with mating slots formed at the rear end of each of the cores to allow drive of the cores. Such insert devices are well-known in the art. At the rearward end of the ribbon cassette assembly, the insert devices at the rear end are each attached, through a respective shaft 37 and 38 that extends through respective openings in back wall 33 and are respectively coupled to respective gears 39 and 40. The gears comprise base members 39*a* and 40*a* that have axially projecting teeth 39*b* and 40*b*. A space is provided between base member 39*a* and 40*a* and back wall 33 that is sufficient to permit mounting of shafts 37 and 38 in respective slots 21 and 22 on loading aid bracket 20.

Figure 5:
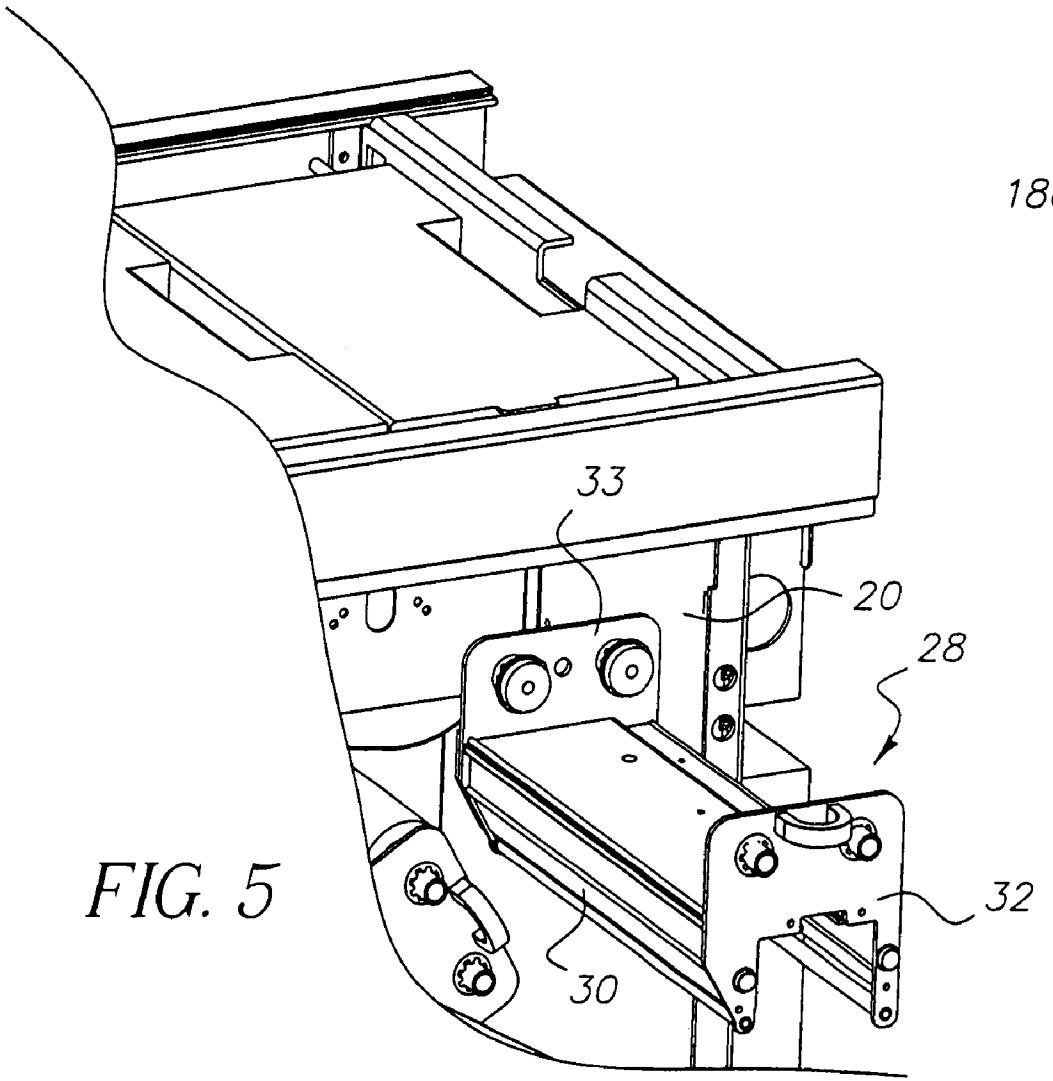
FIG. 5 is a close-up view of the loading aid and illustrating the thermal ribbon cassette assembly mounted on the loading aid.
Figure 7:
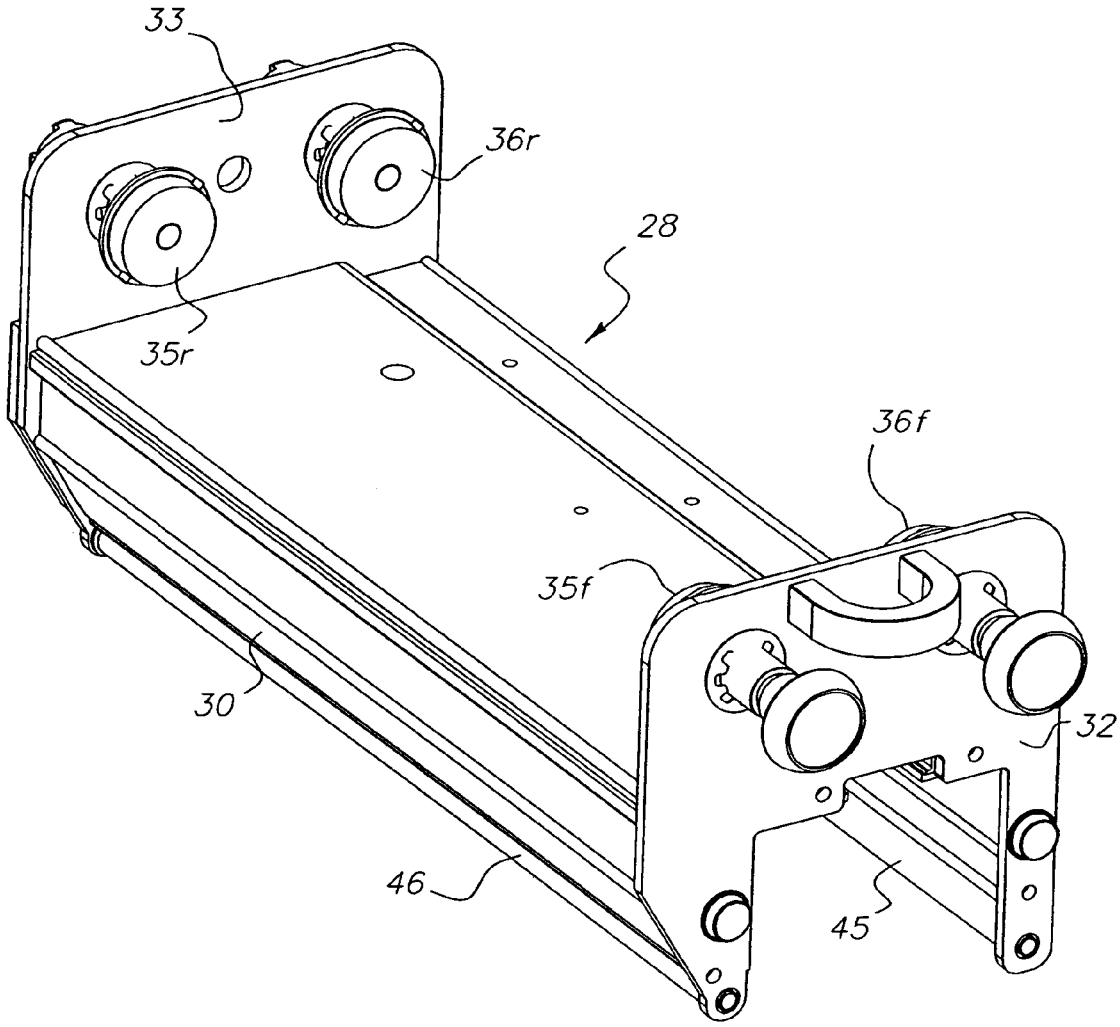
FIGS. 7 and 8 are different perspective views of the thermal ribbon cassette assembly.
Figure 8:
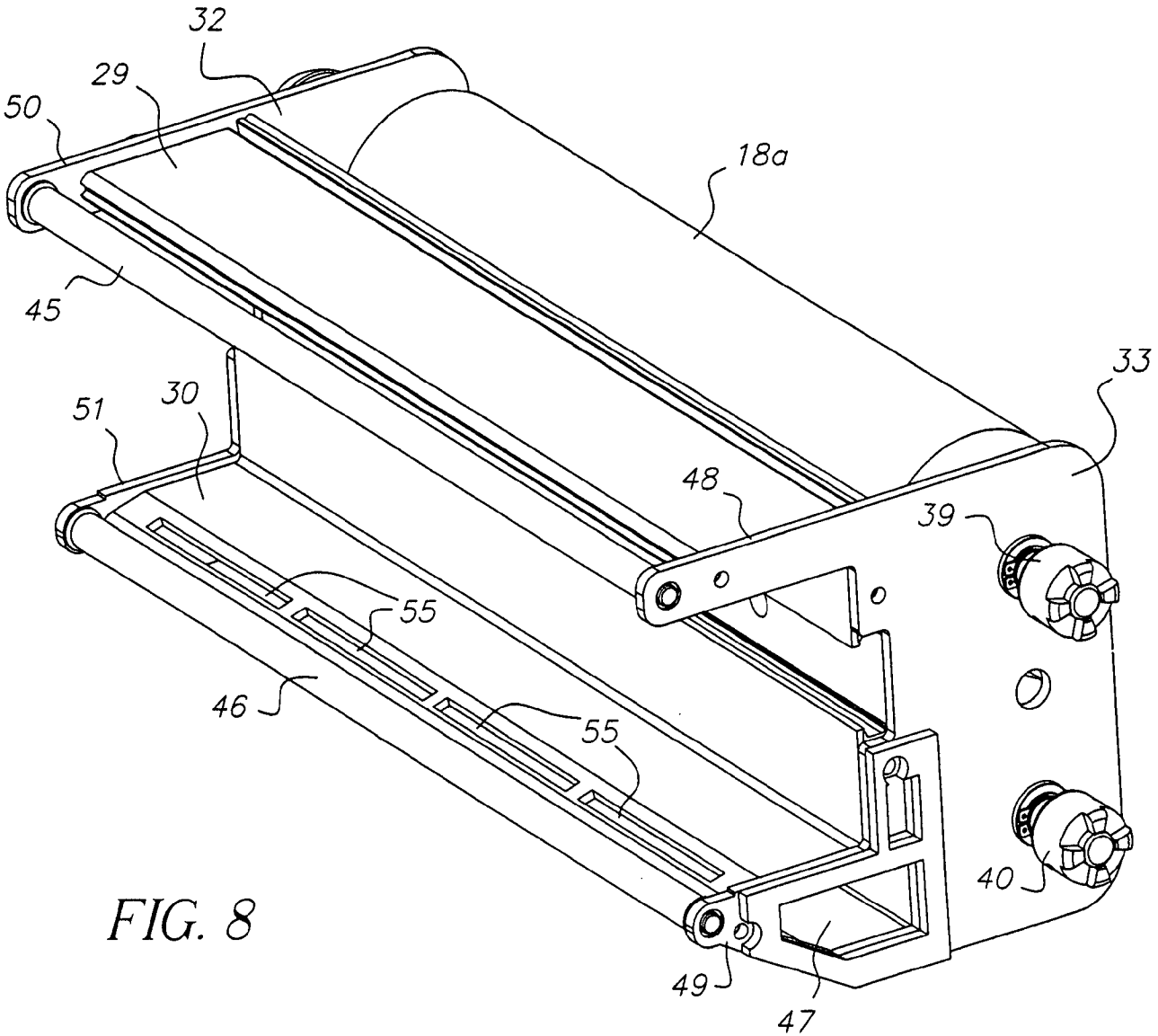

FIGS. 3 and 5 show ribbon cassette assembly 28 mounted to loading aid bracket 20. In FIG. 5, there is shown a close-up view of ribbon cassette assembly 28 mounted on loading aid bracket 20 with the supply and take-up rolls removed and ready to receive a new supply roll and take-up roll. In FIG. 7, the insert devices are shown in the form of gudgeons 35*r*, 35*f*, 36*r* and 36*f* that are spring-loaded to be received within the respective end of each core. FIG. 8 is still another view of the ribbon cassette assembly illustrating more clearly additional structures such as guide rollers 45 and 46 about which the thermal ribbon is wrapped. The guide rollers are supported for rotation in respective openings in depending legs 48 and 49 associated with rear plate 33 and depending legs 50 and 51 associated with front plate 32. Formed within left sidewall 30 is a plenum chamber 47 into which air may be blown from a fan in the printer apparatus to distribute air to the respective print head associated with the ribbon cassette assembly. The air in the plenum exits from openings 55 in wall 30 to impinge upon heat sinks associated with the print head.

Figure 9:
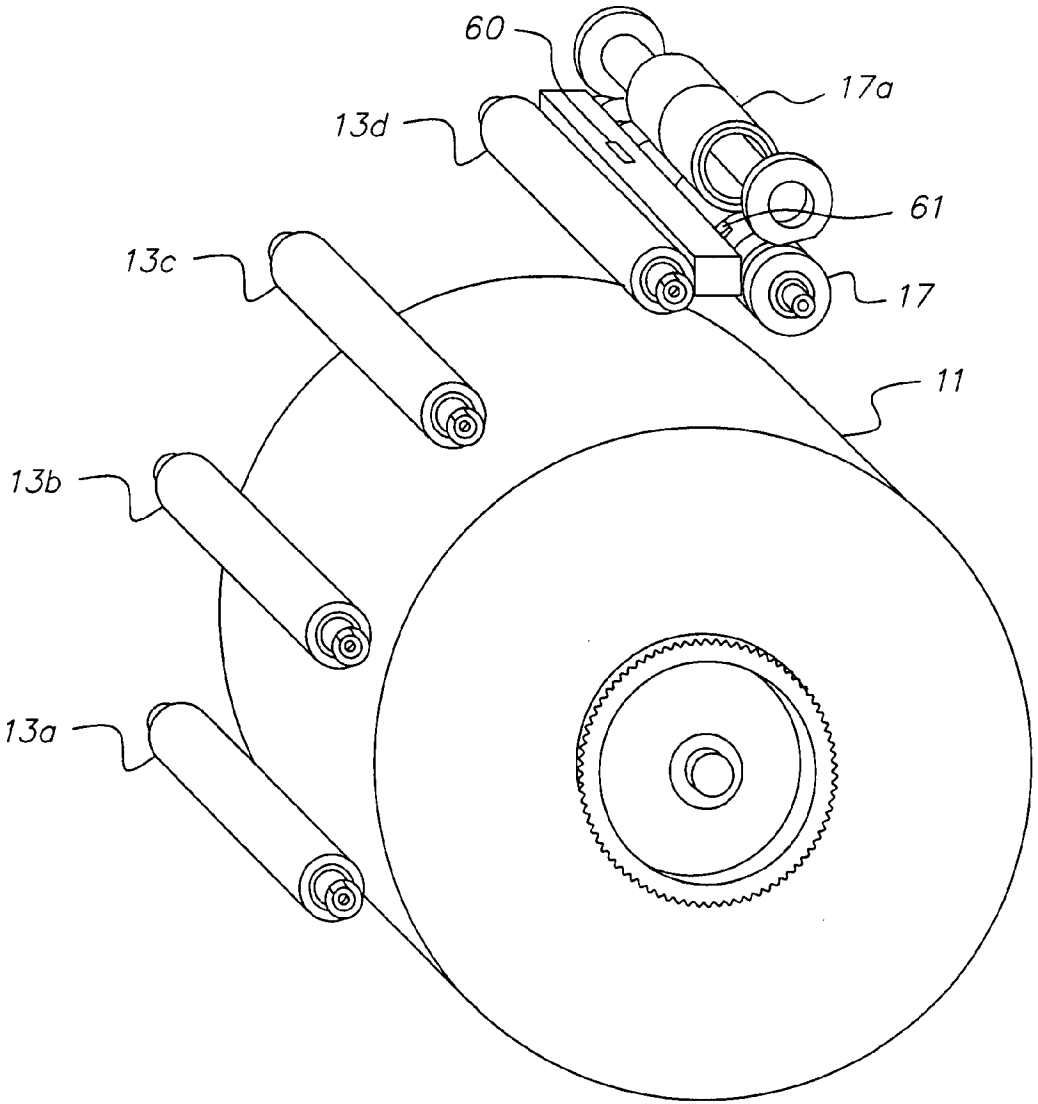
FIG. 9 is a schematic illustration similar to FIG. 1 but viewed from the rear of the apparatus.

FIG. 9 is a schematic illustration similar to FIG. 1 but viewed from the rear of the apparatus. FIG. 9 shows platen rollers 13*a–d*, capstan drive and backup rollers 17 and 17*a*, respectively, and receiver roll 11. A thermistor 60 is positioned to measure the temperature of the receiver as it passes between platen roller 13*d* and the capstan drive and backup roller pair. The thermistor is positioned at the backside of the receiver down stream from the last print station and the lamination print head if provided. Additional sensors along the receiver conveyance path can be used to approximate the receiver temperature. For example, a second thermistor 61 is located in contact with capstan roller 17 used to transport the receiver during printing. Capstan roller 17 and thermistor 61 are located beyond all of the print stations and accumulate thermal energy as the receiver is transported by the capstan roller during printing. Multiple sensors have been found to maximize the accuracy of the temperature measurement.

Figure 10:
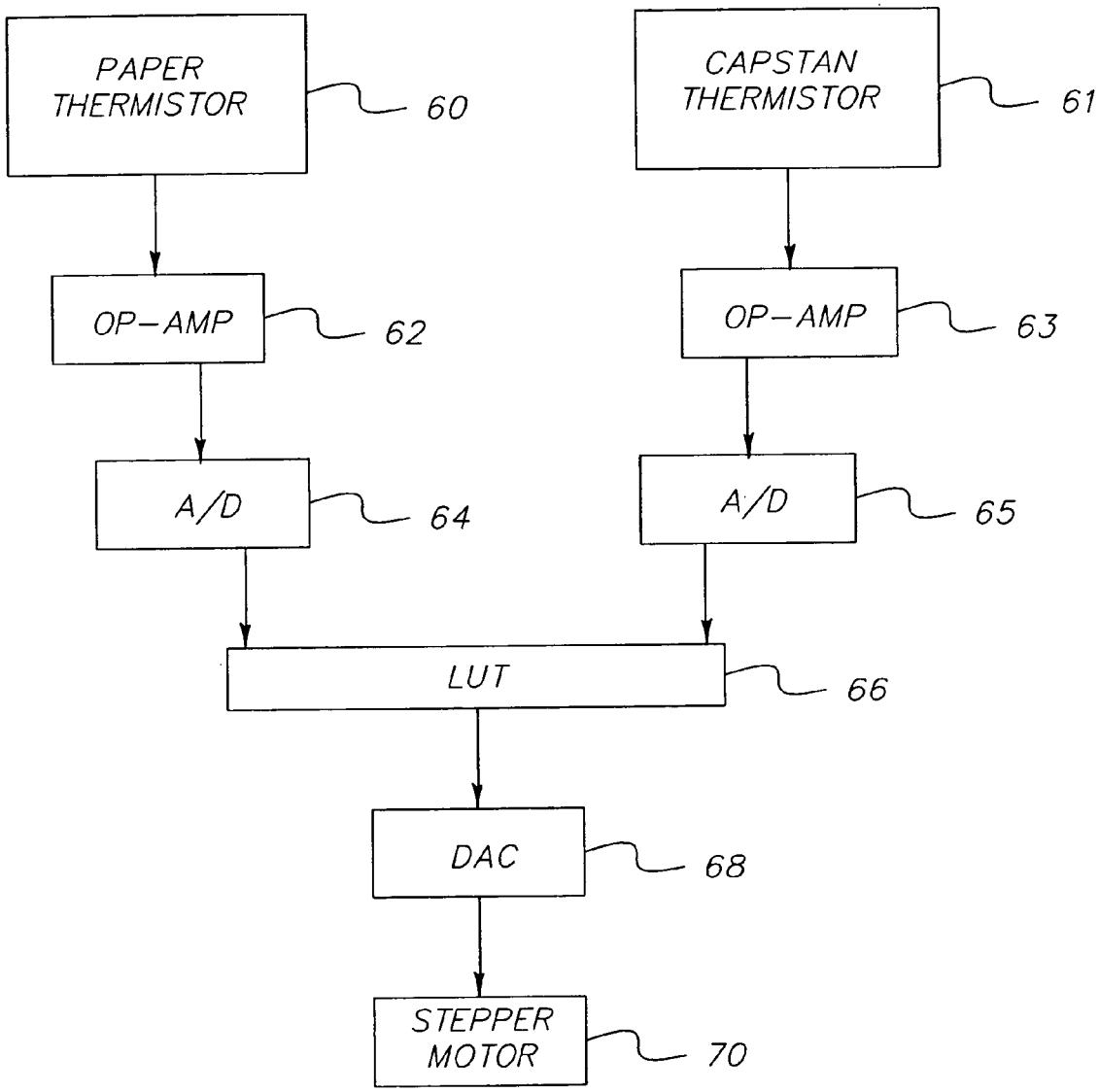
FIG. 10 is a block diagram of a portion of the receiver drive assembly.

Referring to FIG. 10, the resistance of thermistors 60 and 61 are monitored and converted to a voltages by means of an operational amplifiers (OP-AMP) 62 and 63, respectively. In the preferred embodiment, a dynamic range of zero to five volts is preferred for the output of the operational amplifiers. A voltage of zero volts represents the minimum ambient receiver temperature, as would exist when the printer is in an idle standby state for an extended amount of time. A voltage of five volts represents the maximum receiver temperature achieved through continuous printer operation.

Figure 11:
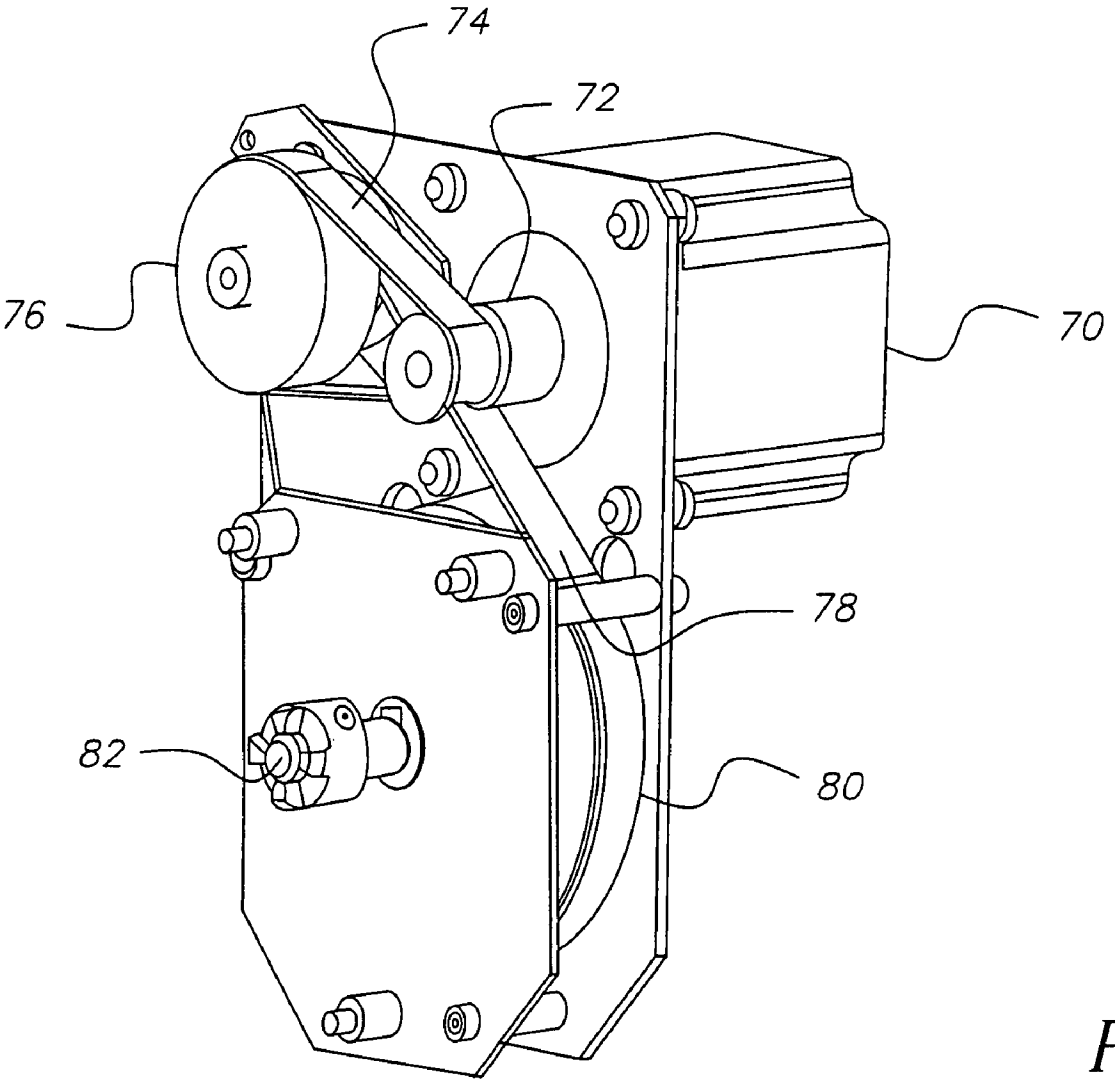
FIG. 11 is a perspective view of a portion of the receiver drive assembly with stepper motor.

The dynamic voltage outputs of the operational amplifiers are preferably converted to representative digital values by the means of Analog to Digital converters (A/D) 64 and 65 and by Lookup Tables (LUT) 66 and 67, respectively. This process enables the measured temperature values to be represented in digital values. Zero volts produces a digital value of zero and five volts produces a digital value of twenty four. Voltages between zero and five equate to digital values derived from a non linear mathematical model of the conveyance characteristic change experienced by the receiver with respect to differences in temperature. The digital values are converted to analog by a digital-to-analog converter (DAC) 68 and integrated into the control circuitry of a stepper motor 70 that is part of the receiver drive assembly illustrated in FIG. 11.

Stepper motor 70 is used to transport the receiver via a motor pulley 72, a belt 74, an intermediate pulley 76, a second belt 78, a drive pulley 80 and a capstan drive coupling 82. As the digital value increases, the stepping rate of the motor is increased in small increments based on the present digital value. This increases the transport velocity of the image receiver.

The image registration improvements described herein provide for fine adjustment of the speed of stepper motor 68 for the purpose of effecting a shim of the average raster line pitch of the printer.

Stepper motors are often driven with a sequenced excitation which simulates a sine/cosine current wave shape in the two windings. This curve shape is realized in quantized form comprised of a sequence of N micro steps per electrical cycle, or stated differently, N/4 micro steps per motor full step. The displacement commanded by N micro steps determines the raster line pitch of the printer. In the most straightforward implementation, each sequence of N micro steps would always repeat the same N sine derived current values for one of the two windings, and the same N cosine derived current values for the other of the two windings. This is preferably implemented by lookup table 66 supplying digital inputs to digital-to-analog converter 68, with N lookup values for each of the two windings.

A degree of speed adjustment can be realized by encoding lookup table 66 more finely, with an integer multiple (value K) of the N lookup values present, describing the sine/cosine wave shape to a finer standard. Performance equal to the situation described above would be achieved if the tabular advance at each micro step is now commanded by the integer K, instead of an implicit value of "ONE" in the technique described above. Stepping would progress with N micro steps per raster line. By altering the tabular advance per micro step (value J) from value K by integer values, the motor displacement over N micro steps would speed up (if J>K) or slow down (if J<K). It is presumed that the time interval between micro steps in not changed. Rather, the displacement associated with each is altered, and therefore a raster line pitch will become accordingly longer or shorter than the pitch associated with a full motor electrical cycle. The achievable graduation of speed is limited by the feasible reference table size to be constructed in the controller memory, and also by a resolution of digital-to-analog converter 68 in the motor control hardware.

A further degree of adjustment for average raster line pitch can be achieved by employing a sequence of non-constant values of the advance index J over a sequence of micro steps. The total displacement over one raster line could be a nominal table displacement of N×K elements, and adjustable by integer values to obtain adjustment to a resolution of one part in N×K.

The necessary feature to implement such would be to construct a micro step advance table, which would hold a sequence of the values to be assigned to the index advance value "J" with each micro step. The micro step advance table would be N elements in length, repeating with each raster line.

Yet finer control could be devised by making the micro step advance table M×N elements in length, and by declaring a sequence of M raster lines to be the cyclic period of the non-uniform micro step advance sequence. This would obtain adjustability of average raster line advance to a resolution of one part in M×N×K. For example, this technique may be implemented with the values of N=24, K=30, and M=12.

The invention has been described in detail with particular reference to preferred embodiments thereof, but it will be understood that variations and modifications may be made in accordance with the spirit and scope of the invention.

What is claimed is:

1. A thermal printer apparatus having a plurality of print stations for recording image information on a web of receiver moving along a path past a plurality of print stations having predetermined average raster line pitches, the apparatus comprising:

an adjustable-speed receiver drive mechanism adapted to advance the receiver along the path;

a sensor adapted to detect the temperature of the receiver along the path; and a controller adapted to adjust the speed of the drive mechanism as a function of the detected temperature of the receiver so as to effect a shim of the average raster line pitch of the printer to compensate for changes in the temperature of the receiver.

2. A thermal printer apparatus as set forth in claim 1, wherein the sensor is a thermistor.

3. A thermal printer apparatus as set forth in claim 1, wherein the sensor is adapted to sense the temperature of the receiver at a position along the path beyond all of said plurality of print stations.

4. A thermal printer apparatus as set forth in claim 1, wherein:

the drive mechanism includes a roller; and the sensor is adapted to sense the temperature of the receiver at a position along the path beyond all of said plurality of print stations and before the roller.

5. A thermal printer apparatus as set forth in claim 1, wherein the drive mechanism:

includes a stepper motor; and increases the stepping rate of the stepper motor based as a function of the detected temperature of the receiver so as to provide an adjustment of the speed of the stepper motor for the purpose of effecting a shim of the average raster line pitch of the printer.

6. A thermal printer apparatus for recording image information on receiver moving past a plurality of print stations having predetermined average raster line pitches, the apparatus comprising:

a ribbon cassette assembly for storing a thermal ribbon having dye, the ribbon cassette assembly including a supply ribbon core, a take-up ribbon core, a supply ribbon support adapted to support the supply ribbon core, and a take-up ribbon support adapted to support the take-up ribbon core;

an elongated thermal print head positionable in engagement with the thermal ribbon for transferring dye from the thermal ribbon to the moving receiver, the print head having a plurality of recording elements arranged in a main scan recording direction that is perpendicular to an advancement direction of the moving receiver, the main scan recording direction also being the direction of elongation of the print head;

an adjustable-speed receiver drive mechanism adapted to advance the receiver along the path in said advancement direction;

a sensor adapted to detect the temperature of the receiver along the path; and a controller adapted to adjust the speed of the drive mechanism as a function of the detected temperature of the receiver so as to effect a shim of the average raster line pitch of the printer to compensate for changes in the temperature of the receiver.

7. A thermal printer apparatus as set forth in claim 6, wherein the sensor is adapted to sense the temperature of the receiver at a position along the path beyond all of said plurality of print stations.

8. The printer apparatus of claim 6 wherein:

the printer apparatus is a multi-color printer apparatus; and there are a plurality of said ribbon cassette assemblies and a respective plurality of said print heads each associated with a said ribbon cassette assembly and each of said print heads.

9. A method for recording image information on a receiver moving along a path past a plurality of print stations having predetermined average raster line pitches, said method including the steps of:

moving the receiver along the path past a plurality of print stations;

detecting the temperature of the receiver along the path; and adjusting the speed of the receiver as a function of the detected temperature of the receiver so as to effect a shim of the average raster line pitch of the printer to compensate for changes in the temperature of the receiver.

10. A method as set forth in claim 9, wherein a thermistor is used to detect the temperature of the receiver.

11. A method as set forth in claim 9, wherein the temperature of the receiver is detected at a position along the path beyond all of said plurality of print stations.

12. A method as set forth in claim 9, wherein:

the moving step includes using a stepper motor; and the adjusting step includes increasing the stepping rate of the stepper motor based as a function of the detected temperature of the receiver so as to provide an adjustment of the speed of the stepper motor for the purpose of effecting a shim of the average raster line pitch of the printer.

13. A method as set forth in claim 9, wherein an empirical model of receiver speed as a function of detected receiver temperature is used in software to predict receiver speed during printing.

14. A method for recording image information on a receiver moving along a path past a plurality of print stations having predetermined average raster line pitches, said method including the steps of:

moving the receiver along the path past a plurality of print stations;

producing an electrical signal having a value that is a function of the temperature of the receiver along the path; and using the electrical signal to adjust the speed of the receiver so as to effect a shim of the average raster line pitch of the printer to compensate for changes in the temperature of the receiver.

15. A thermal printer apparatus having a plurality of print stations for recording image information on a web of receiver moving along a path past a plurality of print stations having predetermined average raster line pitches, the apparatus comprising:

an adjustable-speed receiver drive mechanism adapted to advance the receiver along the path;

multiple sensors adapted to detect the temperature of the receiver and surfaces along the path; and a controller adapted to adjust the speed of the drive mechanism as a function of the detected temperatures so as to effect a shim of the average raster line pitch of the printer to compensate for changes in the temperatures.

16. A thermal printer apparatus as set forth in claim 15, wherein the sensors are thermistors.

17. A thermal printer apparatus as set forth in claim 15, wherein the sensors are adapted to sense the temperatures at positions along the path beyond all of said plurality of print stations.

18. A thermal printer apparatus as set forth in claim 1, wherein:

the drive mechanism includes a capstan drive roller;

one of the sensors is adapted to sense the temperature of the receiver at a position along the path beyond all of said plurality of print stations and before the capstan drive roller; and another of the sensors is adapted to sense the temperature of a surface the capstan drive roller.

19. A thermal printer apparatus as set forth in claim 15, wherein the drive mechanism:

includes a stepper motor; and increases the stepping rate of the stepper motor based as a function of the detected temperatures so as to provide an adjustment of the speed of the stepper motor for the purpose of effecting a shim of the average raster line pitch of the printer.

20. A thermal printer apparatus for recording image information on receiver moving past a plurality of print stations having predetermined average raster line pitches, the apparatus comprising:

a ribbon cassette assembly for storing a thermal ribbon having dye, the ribbon cassette assembly including a supply ribbon core, a take-up ribbon core, a supply ribbon support adapted to support the supply ribbon core, and a take-up ribbon support adapted to support the take-up ribbon core;

an elongated thermal print head positionable in engagement with the thermal ribbon for transferring dye from the thermal ribbon to the moving receiver, the print head having a plurality of recording elements arranged in a main scan recording direction that is perpendicular to an advancement direction of the moving receiver, the main scan recording direction also being the direction of elongation of the print head;

an adjustable-speed receiver drive mechanism adapted to advance the receiver along the path in said advancement direction;

a plurality of sensors adapted to detect the temperature of the receiver and surfaces along the path; and a controller adapted to adjust the speed of the drive mechanism as a function of the detected temperatures so as to effect a shim of the average raster line pitch of the printer to compensate for changes in the temperature of the receiver.

21. A thermal printer apparatus as set forth in claim 20, wherein the sensors are adapted to sense the temperatures at positions along the path beyond all of said plurality of print stations.

* * * * *